US007936118B2

(12) United States Patent
Lin et al.

(10) Patent No.: US 7,936,118 B2
(45) Date of Patent: May 3, 2011

(54) LIGHT SOURCE APPARATUS COMPRISING A STACK OF LOW PRESSURE GAS FILLED LIGHT EMITTING PANELS AND BACKLIGHT MODULE

(75) Inventors: Yi-Ping Lin, Changhua County (TW); Jung-Yu Li, Taipei County (TW); Shih-Pu Chen, Hsinchu (TW); Wei-Chih Lin, Taipei County (TW); Lian-Yi Cho, Miaoli County (TW)

(73) Assignee: Industrial Technology Research Institute, Hsinchu (TW)

( * ) Notice: Subject to any disclaimer, the term of this patent is extended or adjusted under 35 U.S.C. 154(b) by 430 days.

(21) Appl. No.: 12/039,751

(22) Filed: Feb. 29, 2008

(65) Prior Publication Data

US 2008/0211377 A1 Sep. 4, 2008

Related U.S. Application Data

(63) Continuation-in-part of application No. 11/747,234, filed on May 11, 2007.

(30) Foreign Application Priority Data

Mar. 2, 2007 (TW) ..... 96107136 A
Aug. 3, 2007 (TW) ..... 96128647 A
Dec. 4, 2007 (TW) ..... 96147952 A

(51) Int. Cl.
*H01J 19/06* (2006.01)
*H01K 1/04* (2006.01)

(52) U.S. Cl. ..... 313/346 R; 313/306; 313/310

(58) Field of Classification Search ..... 313/306, 313/309–310, 346, 351, 355
See application file for complete search history.

(56) References Cited

U.S. PATENT DOCUMENTS

| | | | | |
|---|---|---|---|---|
| 6,346,775 | B1 * | 2/2002 | Lee et al. | 315/169.3 |
| 7,586,251 | B2 * | 9/2009 | Jung et al. | 313/348 |
| 2002/0146853 | A1 * | 10/2002 | Karpov et al. | 438/20 |
| 2003/0001492 | A1 * | 1/2003 | Pei et al. | 313/496 |
| 2005/0062413 | A1 * | 3/2005 | Francke | 313/512 |
| 2006/0125373 | A1 * | 6/2006 | Lin et al. | 313/495 |
| 2006/0232187 | A1 * | 10/2006 | Lin et al. | 313/496 |
| 2007/0035941 | A1 * | 2/2007 | Lee et al. | 362/97 |
| 2007/0049154 | A1 | 3/2007 | Chang et al. | |
| 2007/0128413 | A1 * | 6/2007 | Chuang et al. | 428/172 |
| 2007/0164651 | A1 | 7/2007 | Fu et al. | |

(Continued)

FOREIGN PATENT DOCUMENTS

CN 1259684 7/2000

(Continued)

OTHER PUBLICATIONS

"1st Office Action of Chinese counterpart application", issued on Jun. 26, 2009, p. 1-9.

*Primary Examiner* — Peter Macchiarolo
*Assistant Examiner* — Jose M Diaz
(74) *Attorney, Agent, or Firm* — Jianq Chyun IP Office

(57) ABSTRACT

A light source apparatus applicable to a backlight module includes a cathode structure, an anode structure, a fluorescent layer, a secondary electron generation layer, and a low-pressure gas layer. The fluorescent layer is located between the cathode structure and the anode structure. The low-pressure gas layer is filled between the cathode structure and the anode structure. The secondary electron generation layer is disposed on the cathode structure and can generate additional secondary electrons to hit the fluorescent layer for improving the luminous efficiency.

10 Claims, 7 Drawing Sheets

U.S. PATENT DOCUMENTS

| | | | | |
|---|---|---|---|---|
| 2007/0200509 | A1* | 8/2007 | Lin et al. | 315/169.4 |
| 2007/0222364 | A1 | 9/2007 | Qian et al. | |
| 2007/0229003 | A1 | 10/2007 | Park et al. | |
| 2008/0100916 | A1* | 5/2008 | Suhl | 359/601 |
| 2008/0143241 | A1 | 6/2008 | Li et al. | |
| 2008/0150835 | A1 | 6/2008 | Paik et al. | |
| 2008/0150876 | A1* | 6/2008 | Kuo | 345/102 |

FOREIGN PATENT DOCUMENTS

| | | |
|---|---|---|
| CN | 1618113 | 5/2005 |
| CN | 1794399 | 6/2006 |
| CN | 1940676 | 4/2007 |
| JP | 2005-044616 | 2/2005 |
| JP | 2006-179467 | 7/2006 |

* cited by examiner

LIGHT SOURCE APPARATUS COMPRISING A STACK OF LOW PRESSURE GAS FILLED LIGHT EMITTING PANELS AND BACKLIGHT MODULE

CROSS-REFERENCE TO RELATED APPLICATION

This application is a continuation-in-part of a prior application Ser. No. 11/747,234, filed May 11, 2007. The prior application Ser. No. 11/747,234 claims the priority benefit of Taiwan application serial no. 96107136, filed on Mar. 2, 2007. This application also claims the priority benefits of Taiwan applications of Ser. No. 96128647, filed Aug. 3, 2007, and Ser. 96147952, filed Dec. 14, 2007. The entirety of each of the above-mentioned patent applications is hereby incorporated by reference herein and made a part of this specification.

BACKGROUND OF THE INVENTION

1. Field of the Invention

The present invention generally relates to a planar light source apparatus applicable to a liquid crystal backlight module.

2. Description of Related Art

Light source apparatuses are widely used in the daily life. The conventional light source apparatuses such as light bulbs produce a visible light source by passing a current through filaments to heat up. The light bulbs are generally spot light sources. Later, the tube light source is developed. After a long term development and modification, planar light source devices are put forth and widely used in planar displays.

Light source may be produced through many mechanisms. FIG. 1 is a schematic cross-sectional view showing a conventional planar light source apparatus mechanism. Referring to FIG. 1, the light emitting mechanism is realized by connecting two electrode structures 100 and 102 to a power supply 106 to generate an electric field under an operating voltage, and then ionizing the gas 104 though gas discharging (also referred to as plasma discharging) to generate electrons 110. The electrons 110 is accelerated by the electric field to hit the corresponding red, green, and blue fluorescent layers 108*a*, 108*b*, and 108*c* on the electrode structure 102. The visible lights 112 are then generated and emitted through the fluorescent layer. Herein, the electrode structure 100 is a light-emitting surface, and generally is made of a light transmissive material constituted by a glass substrate and an indium-tin-oxide (ITO) transparent conductive layer.

Another light source generating mechanism is the field emission mechanism as shown in FIG. 2. FIG. 2 is a schematic cross-sectional view showing another conventional planar light source apparatus mechanism. The conventional planar light source apparatus includes a glass substrate 120, a cathode structure layer 122, a plurality of conical conductors 124, a gate layer 126, an anode structure layer 128, and a fluorescent layer 130. The cathode structure layer 122 is disposed on the glass substrate 120. A plurality of conical conductors 124 is disposed on the cathode structure layer 122. A gate layer 126 is disposed on the conical conductor 124. A plurality of holes corresponding to the conical conductors 124 is formed in the gate layer 126. The anode structure layer 128 has a transparent anode layer disposed on a glass substrate. Moreover, the fluorescent layer 130 is disposed on the anode structure layer 128. The electrons 132 escape from the tip of the conical conductor 124 under the high electric field between the cathode and the anode and are accelerated by the electric field to hit the fluorescent layer 130 so as to emit visible lights.

The above two conventional light-emitting mechanisms have respective advantages and disadvantages. The gas discharge manner is easy and the structure is simple, but the plasma is generated in the process, thus consuming energy. The field emission light source is a kind of cold light source and has a similar principle like the cathode ray tube (CRT) wherein the electrons escape from the cathode under the high electric field between the cathode and the anode and then hit the phosphors coated on the anode to emit light. The field emission light source is advantageous in high brightness and power saving, and is easy to be made into a planar structure. However, the field emission light source has the disadvantages that the emission material needs a spindle structure or carbon nanotube to grow or be uniformly coated on the cathode. This planar fluorescent lamp must use a support to separate the cathode and the anode, and the vertical distance between the cathode and the anode must be adjusted carefully. Since the tolerance is small, the cost of the structure design and the yield must be taken into account in mass application, and the uniformity of the overall light brightness is difficult to control. Moreover, the vacuum packaging is also a problem.

SUMMARY OF THE INVENTION

The present invention is directed to a light source apparatus, which is easy to be fabricated into a planar light source without requiring a high vacuum degree, has a better brightness and luminous efficiency, and can operate under a lower operating voltage.

The present invention is directed to a backlight source module, which is realized by the light source apparatus.

The present invention provides a light source apparatus, which includes a cathode structure with a light transmission property serving as a light-emitting surface, an anode structure with a light reflectivity located opposite to the cathode structure, a fluorescent layer located between the cathode structure and the anode structure, and a low-pressure gas layer filled between the cathode structure and the anode structure. The low-pressure gas layer functions to induce the cathode to uniformly emit electrons, and has a large electron mean free path allowing electrons to directly hit the fluorescent layer under an operating voltage, so as to generate desired lights.

The present invention is also directed to a light source apparatus, which includes a cathode structure with a light transmission property, an anode structure with a light transmission reflectivity located opposite to the cathode structure, a discharge layer located on at least one of the cathode structure and the anode structure, a fluorescent layer located between the cathode structure and the anode structure, and a low-pressure gas layer filled between the cathode structure and the anode structure. The low-pressure gas layer functions to induce the cathode to uniformly emit electrons, and has a large electron mean free path allowing electrons to hit the fluorescent layer directly under an operating voltage.

The present invention is also directed to a backlight source apparatus, which includes at least one power controller for providing at least one operating voltage, and a light emitting unit including at least one light emitting panel controlled by the operating voltage. The light emitting panel includes a cathode structure, an anode structure located opposite to the cathode structure, a fluorescent layer located between the cathode structure and the anode structure, and a low-pressure gas layer filled between the cathode structure and the anode structure. The low-pressure gas layer functions to induce the cathode to uniformly emit electrons, and has a large electron mean free path allowing electrons to directly hit the fluorescent layer under an operating voltage.

In order to make the aforementioned and other objectives, features and advantages of the present invention comprehensible, preferred embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
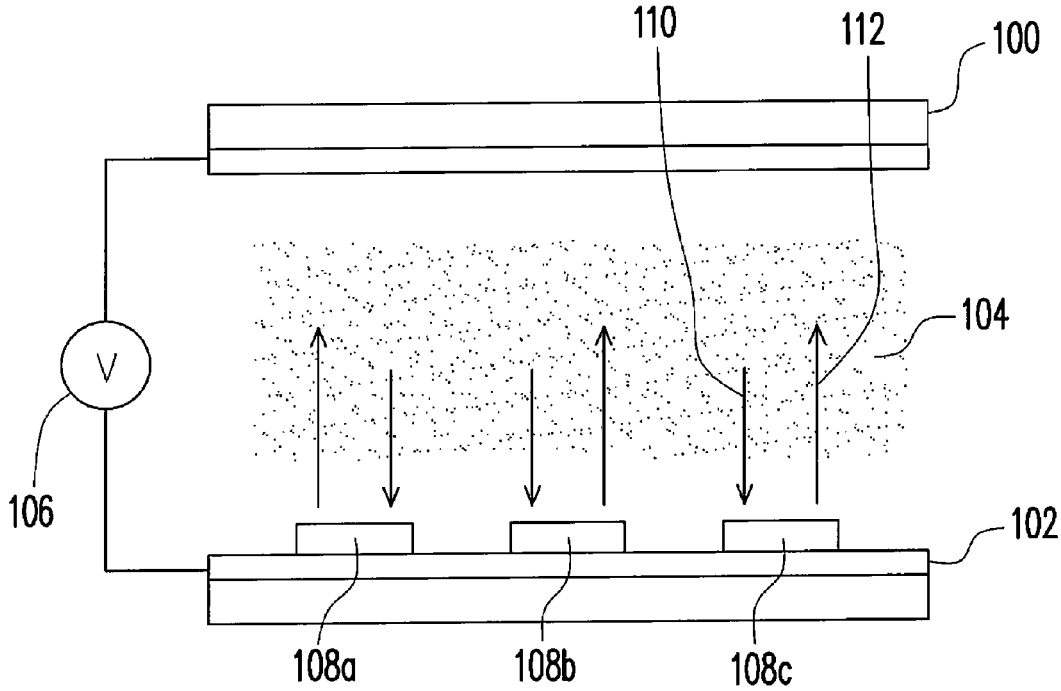
FIG. 1 (PRIOR ART)
FIG. 1 is a schematic cross-sectional view showing a conventional planar light source apparatus mechanism.
Figure 2:
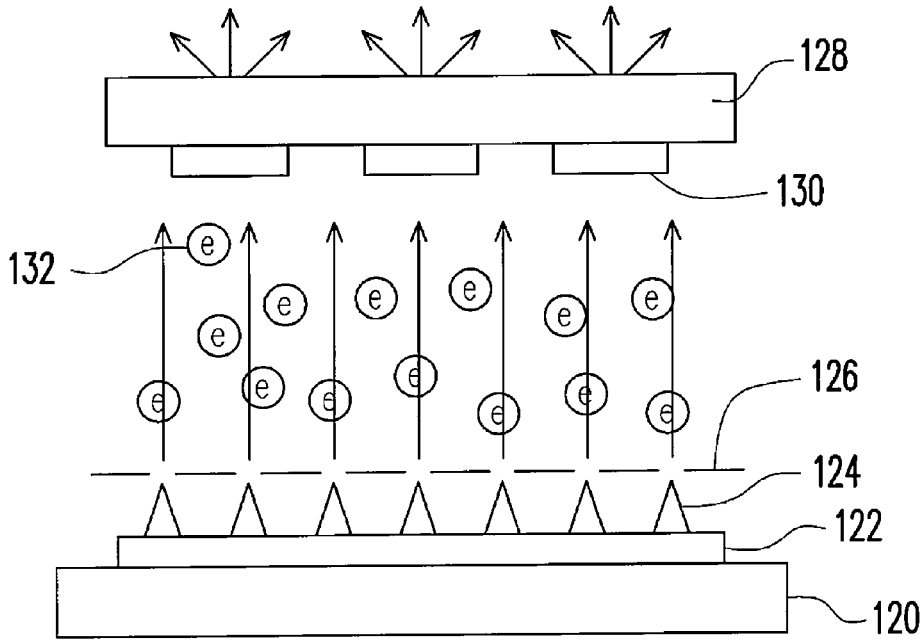
FIG. 2 (PRIOR ART)
FIG. 2 is a schematic cross-sectional view showing another conventional planar light source apparatus mechanism.

Reference will now be made in detail to the present preferred embodiments of the invention, examples of which are illustrated in the accompanying drawings. Wherever possible, the same reference numbers are used in the drawings and the description to refer to the same or like parts.

Hereinafter, some embodiments are described for illustrating the features of the present invention, and will not intended to limit the scope of the present invention.

The First Embodiment

Figure 3:
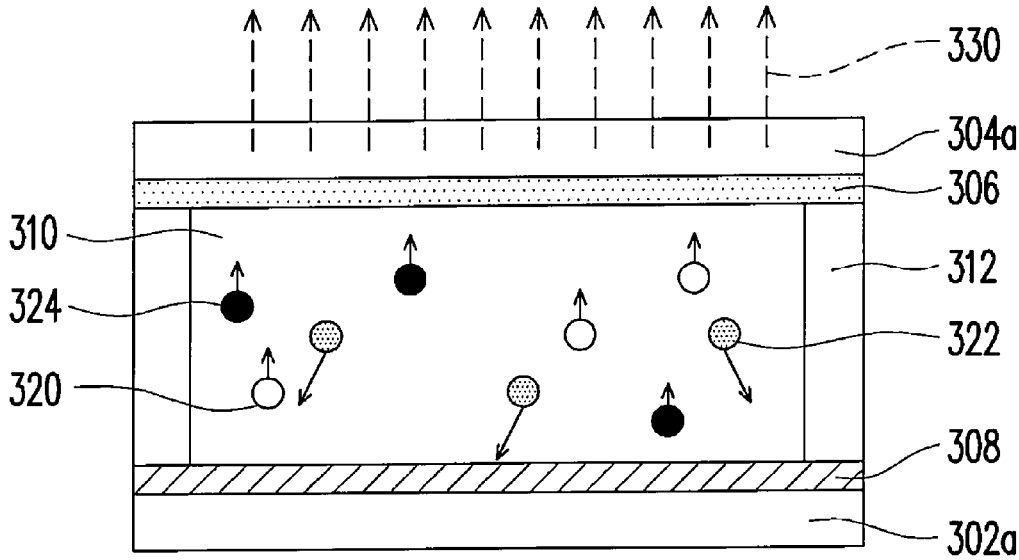
FIG. 3 is a schematic cross-sectional view of a light source apparatus according to an embodiment of the present invention.

FIG. 3 is a schematic cross-sectional view of a light source apparatus according to an embodiment of the present invention. Referring to FIG. 3, the light source apparatus includes a cathode structure 302*a*, an anode structure 304*a*, a fluorescent layer 306, a secondary electron generation layer 308, and a low-pressure gas layer 310.

The material of the cathode structure 302*a* is a glass substrate with a metal layer or a transparent conductive material evaporated thereon. The anode structure 304*a* is located opposite to the cathode structure 302*a*. The anode structure 304*a* is a light transmissive structure, and the material thereof is an indium-tin-oxide (ITO), a fluorin-doped tin oxide (FTO), or another transparent conductive oxide (TCO) material. The cathode structure 302*a* and the anode structure 304*a* basically include, for example, a substrate and an electrode layer on the substrate. The actual structure of the cathode structure 302*a* and the anode structure 304*a* may vary depending on actual design, which is apparent to those of ordinary skill in the art, and will not be described herein.

The fluorescent layer 306 is disposed between the cathode structure 302*a* and the anode structure 304*a*, and is generally disposed on, for example, the anode structure 304*a*.

The secondary electron generation layer 308 is disposed on the cathode structure 302*a*. The material of the secondary electron generation layer 308 may be MgO, $Tb_2O_3$, $La_2O_3$, or $CeO_2$.

The low-pressure gas layer 310 is disposed between the cathode structure 302 and the anode structure 304, in which a low-pressure gas in a range of 10 to $10^{-3}$ torr for enabling the electron mean free path to be approximately the distance between cathode and anode.

In an embodiment, the light source apparatus in FIG. 3 further comprises a sidewall structure 312 for separating the cathode structure 302*a* and the anode structure 304*a* by a distance, and meanwhile enclosing to form a low-pressure gas layer 310 for the low-pressure gas to be filled therein.

In the embodiment of the present invention, a thin gas is used to easily induce enough electrons 320 uniformly. A field emission mechanism is used to allow the ionized electrons 320 to hit the fluorescent layer 306, so as to generate desired lights. Since the ionized positive ions 322 in the gas may hit the secondary electron generation layer 308, additional secondary electrons 324 may be generated to hit the fluorescent layer 306 when the positive ions hit the secondary electron generation layer 308, thus improving the luminous efficiency.

In this embodiment, the anode structure 304*a* is a light transmissive structure, when the electrons 320 hit the fluorescent layer 306, the generated lights 330 pass through the anode structure 304*a*. This light source apparatus is also referred to as a transmissive light source apparatus. Moreover, in the transmissive light source apparatus, the cathode structure 302*a* may be a high-reflective metal capable of improving the reflectivity and increasing the brightness and luminous efficiency.

It should be noted that since the filled gas is used to induce the cathode to uniformly emit electrons, the selected gas is not particularly restricted, and may be any gas or gas mixture, for example, atmospheric air, He, Ne, Ar, Kr, Xe, $H_2$, or $CO_2$. Since the filled gas has a low or medium vacuum degree, the electron mean free path is large enough to allow the electrons to directly hit the material of the fluorescent layer 306 in the electric field, so as to emit desired lights.

Figure 4:
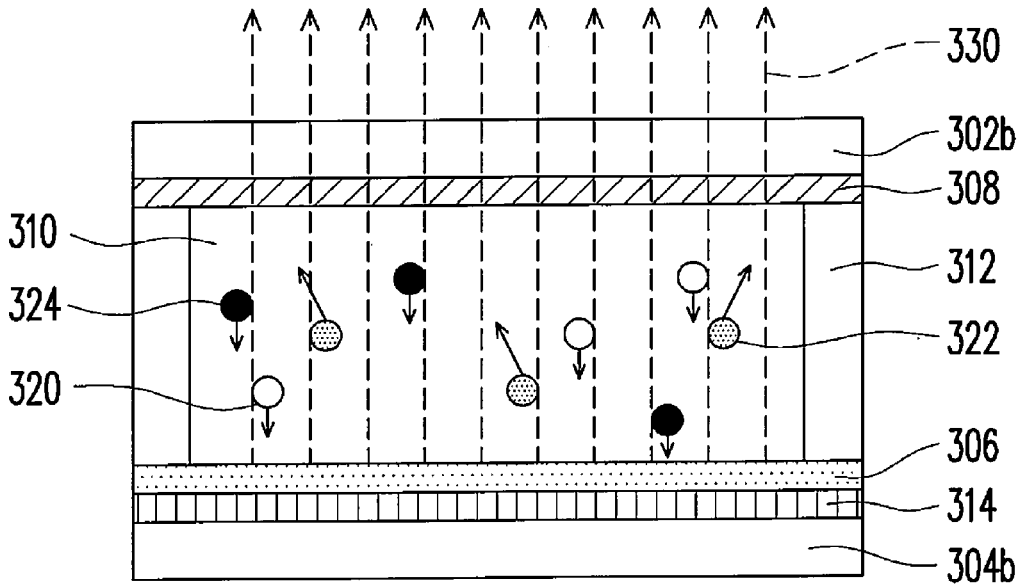
FIG. 4 is a schematic cross-sectional view of a light source apparatus according to an embodiment of the present invention.

The embodiment of FIG. 3 may be implemented in another form as shown in FIG. 4. FIG. 4 is a schematic cross-sectional view of a light source apparatus according to an embodiment of the present invention. Referring to FIG. 4, the light source apparatus includes a cathode structure 302*b*, an anode structure 304*b*, a fluorescent layer 306, a secondary electron generation layer 308, a low-pressure gas layer 310, a sidewall structure 312, and a reflective layer 314.

The light source apparatus as shown in FIG. 4 is similar to the light source apparatus in FIG. 3, but has the following differences. The light source apparatus in FIG. 4 further includes a reflective layer 314 disposed between the anode structure 304*b* and the fluorescent layer 306. Moreover, the cathode structure 302*b* is a light transmissive structure, and the material thereof is, for example, an indium-tin-oxide, a fluorin-doped tin oxide, or another transparent conductive oxide (TCO) material. The anode structure 304*b* may be a transmissive or an opaque material.

When the electrons 320 generated by the gas discharging mechanism and the additional secondary electrons 324 generated by the positive ions 322 hitting the secondary electron generation layer 308 hit the fluorescent layer 306, the generated light 330 is reflected by the reflective layer 314 to pass through the cathode structure 302*b*. The light source apparatus is also referred to as a reflective light source apparatus. Moreover, in the reflective light source apparatus, the anode structure 304*b* is formed by evaporating a transparent conductive material on the glass, and the reflective layer 314 may be a high-reflective metal or high-reflective optical film with a high-reflective metal evaporated thereon, for improving the reflectivity and increasing the brightness and luminous efficiency.

The Second Embodiment

Figure 5:
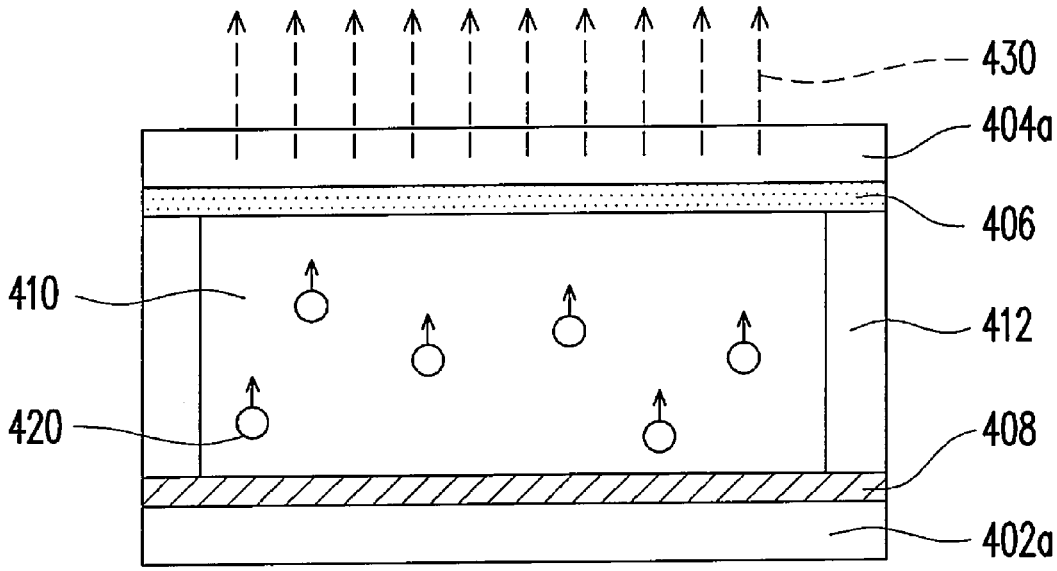
FIG. 5 is a schematic cross-sectional view of a light source apparatus according to an embodiment of the present invention.

FIG. 5 is a schematic cross-sectional view of a light source apparatus according to an embodiment of the present invention. Referring to FIG. 5, a light source apparatus includes a cathode structure 402*a*, an anode structure 404*a*, a fluorescent layer 406, a discharge layer 408, and a low-pressure gas layer 410.

The material of the cathode structure 402*a* is a glass substrate with a metal layer or a transparent conductive material evaporated thereon. The anode structure 404*a* is located opposite to the cathode structure 402*a*. The anode structure 404*a* is a light transmissive structure, and the material thereof is. for example, an indium-tin-oxide (ITO), a fluorine-doped tin oxide (FTO), or another transparent conductive oxide (TCO) material. The cathode structure 402*a* and the anode structure 404*a* basically include, for example, a substrate and an electrode layer on the substrate. The actual structure of the cathode structure 402*a* and the anode structure 404*a* may vary depending on actual design, which is apparent to those of ordinary skill in the art, and will not be described herein.

The fluorescent layer 406 is disposed between the cathode structure 402*a* and the anode structure 404*a*, and is generally disposed on, for example, the anode structure 404*a*.

The discharge layer 408 is disposed on the cathode structure 402*a*. The material of the discharge layer 408 may be a material capable of easily discharging, such as a metal, carbon nanotube, carbon nanowall, carbon nanomaterial, column ZnO, or ZnO film.

The low-pressure gas layer 410 is disposed between the cathode structure 402*a* and the anode structure 404*a*, in which a low-pressure gas in a range of 10 to $10^{-3}$ torr for enabling the electron mean free path to be approximately the distance between cathode and anode.

In an embodiment, the light source apparatus further includes a sidewall structure 412 for separating the cathode structure 402*a* and the anode structure 404*a* by a distance, and meanwhile enclosing to form a low-pressure gas layer 410 for the low-pressure gas to be filled therein.

In the present invention, a thin gas is used to easily induce enough electrons 420 uniformly. A high voltage is used to allow the ionized electrons 420 to hit the fluorescent layer 406, so as to generate desired lights. In this embodiment, since the discharge layer 408 is a material capable of easily discharging, the operating voltage may be reduced.

In this embodiment, the anode structure 404*a* is a light transmissive structure, and the material thereof is, for example, an indium-tin-oxide, a fluorin-doped tin oxide, or another transparent conductive oxide (TCO) material. Therefore, when the electrons 420 hit the fluorescent layer 406, the generated lights 430 pass through the anode structure 404*a*. The light source apparatus is also referred to as a transmissive light source apparatus. Moreover, in the transmissive light source apparatus, the cathode structure 402*a* may be a high-reflective metal capable of improving the reflectivity and increasing the brightness and luminous efficiency.

It should be noted that since the filled gas is used to induce the cathode to uniformly emit electrons, the selected gas is not particularly restricted, and may be any gas or gas mixture, such as atmospheric air, He, Ne, Ar, Kr, Xe, $H_2$, or $CO_2$. Since the filled gas has a low or medium vacuum degree, the electron mean free path is large enough to allow the electrons to directly hit the material of the fluorescent layer 406 in the electric field, so as to emit desired lights.

Figure 6:
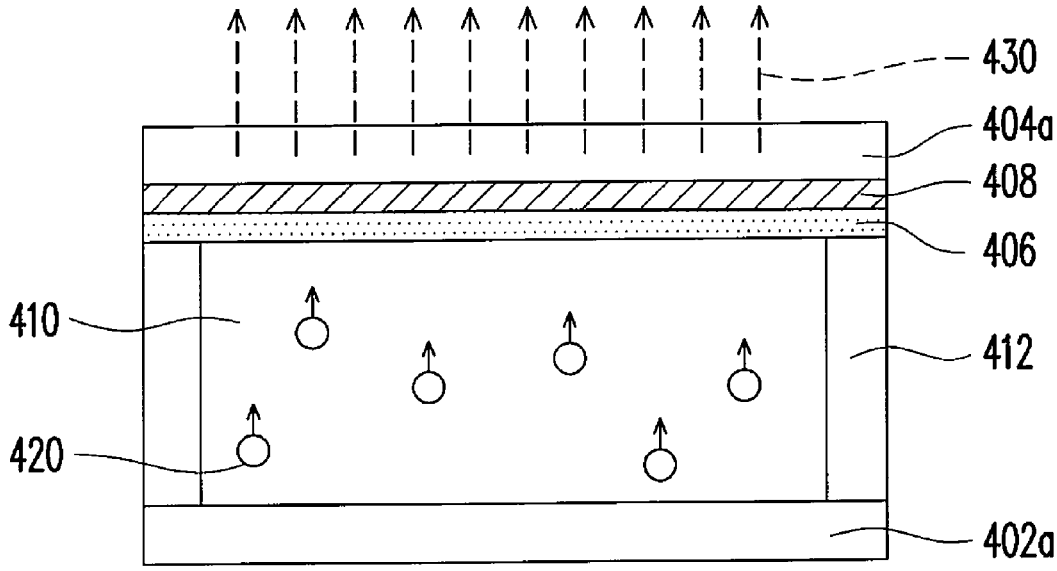
FIG. 6 is a schematic cross-sectional view of a light source apparatus according to an embodiment of the present invention.

The embodiment in FIG. 5 may be implemented in another form as shown in FIG. 6. FIG. 6 is a schematic cross-sectional view of a light source apparatus according to an embodiment of the present invention. The light source apparatus shown in FIG. 6 has the structure and function similar to the light source apparatus in FIG. 5, and will not be illustrated herein again. Referring to FIG. 6, the difference between the light source apparatus in FIG. 6 and the light source apparatus in FIG. 5 lies in that the discharge layer 408 is disposed between the anode structure 404*a* and the fluorescent layer 406.

Figure 7:
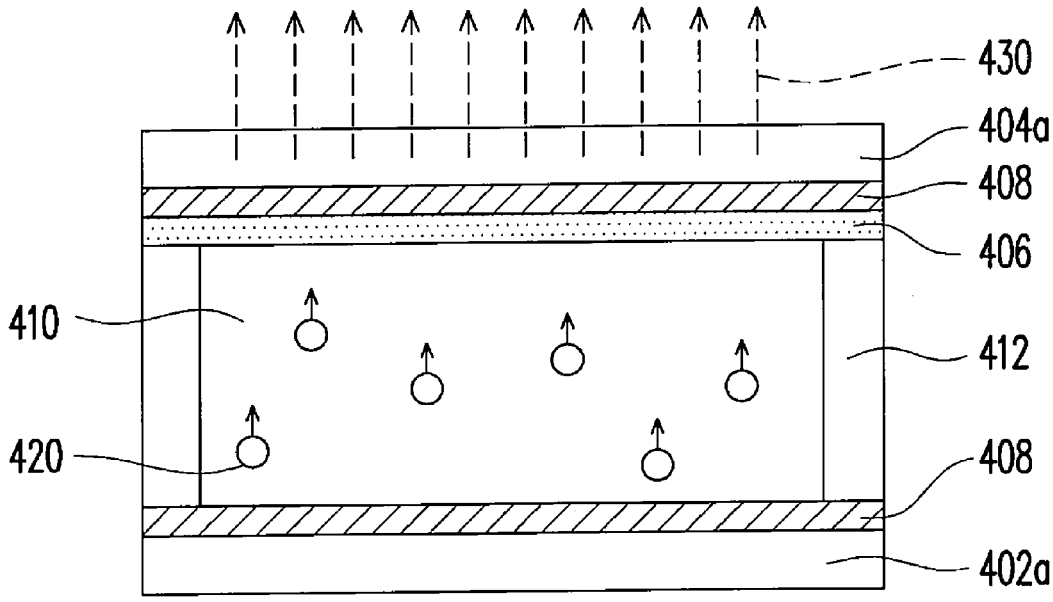
FIG. 7 is a schematic cross-sectional view of a light source apparatus according to an embodiment of the present invention.

The embodiment in FIG. 5 may be implemented in another form as shown in FIG. 7. FIG. 7 is a schematic cross-sectional view of a light source apparatus according to an embodiment of the present invention. The light source apparatus shown in FIG. 7 has the structure and function similar to the light source apparatus in FIG. 5, and will not be illustrated herein again. Referring to FIG. 7, the difference between the light source apparatus in FIG. 7 and the light source apparatus in FIG. 5 lies in that the discharge layer 408 is disposed on the cathode structure 402*a* and between the anode structure 404*a* and the fluorescent layer 406.

Figure 8:
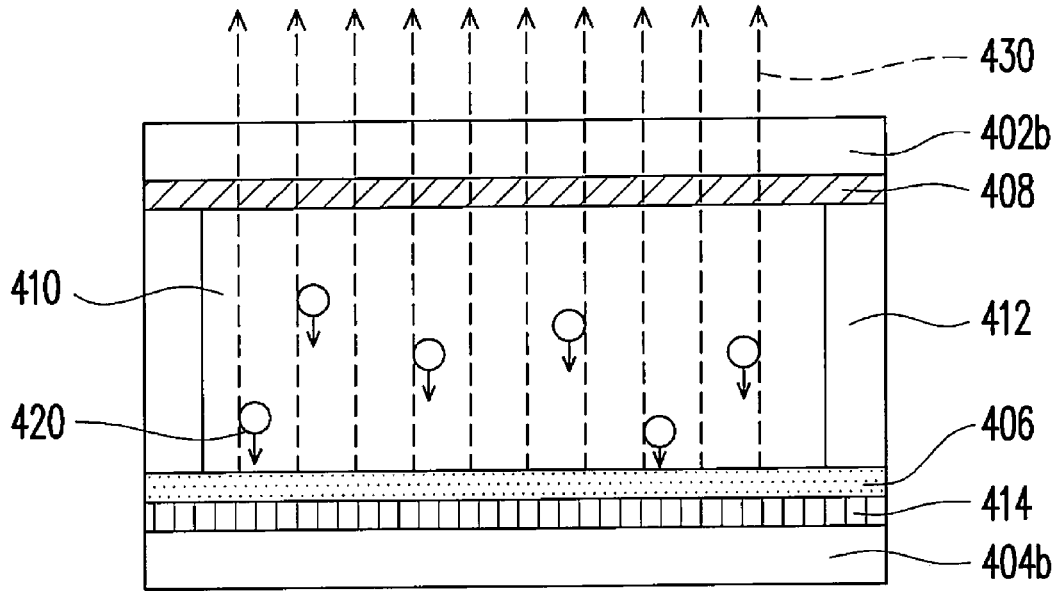
FIG. 8 is a schematic cross-sectional view of a light source apparatus according to an embodiment of the present invention.

The embodiment in FIG. 5 may be implemented in another form, as shown in FIG. 8. FIG. 8 is a schematic cross-sectional view of a light source apparatus according to an embodiment of the present invention. Referring to FIG. 8, the light source apparatus includes a cathode structure 402*b*, an anode structure 404*b*, a fluorescent layer 406, a discharge layer 408, a low-pressure gas layer 410, a sidewall structure 412, and a reflective layer 414.

The light source apparatus as shown in FIG. 8 is similar to the light source apparatus in FIG. 5, but has the following difference. The light source apparatus in FIG. 8 further includes a reflective layer 414 disposed on the anode structure layer. Moreover, the cathode structure 402*b* is a light transmissive structure, and the material thereof is, for example, an indium-tin-oxide, a fluorin-doped tin oxide, or another transparent conductive oxide (TCO) material. The anode structure 404*b* may be a transmissive or an opaque material.

When the electrons 420 hit the fluorescent layer 406, the generated light 430 is reflected by the reflective layer 414 to pass through the cathode structure 402*b*. The light source apparatus is also referred to as a reflective light source apparatus. In the reflective light source apparatus, the anode structure 404*b* is preferably a high-reflective metal capable of improving the reflectivity and increasing the brightness and luminous efficiency.

Figure 9:
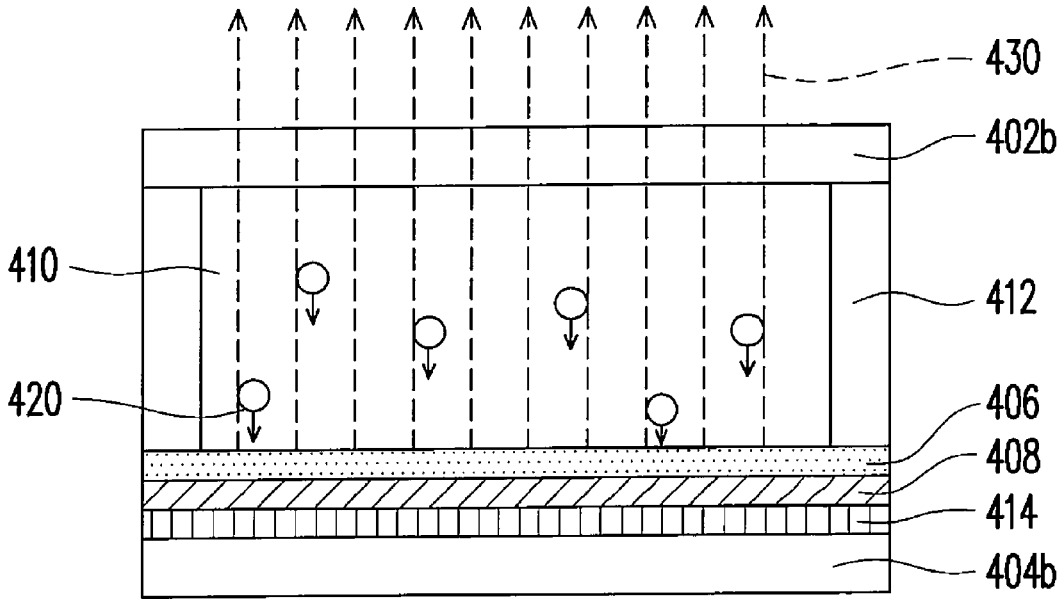
FIG. 9 is a schematic cross-sectional view of a light source apparatus according to an embodiment of the present invention.

The embodiment in FIG. 8 may be implemented in another form as shown in FIG. 9. FIG. 9 is a schematic cross-sectional view of a light source apparatus according to an embodiment of the present invention. The light source apparatus as shown in FIG. 9 has the structure and function similar to the light source apparatus in FIG. 8, and will not be illustrated herein again. Referring to FIG. 9, the difference between the light source apparatus in FIG. 9 and the light source apparatus in FIG. 8 lies in that the discharge layer 408 is disposed between the reflective layer 414 and the fluorescent layer 406.

Figure 10:
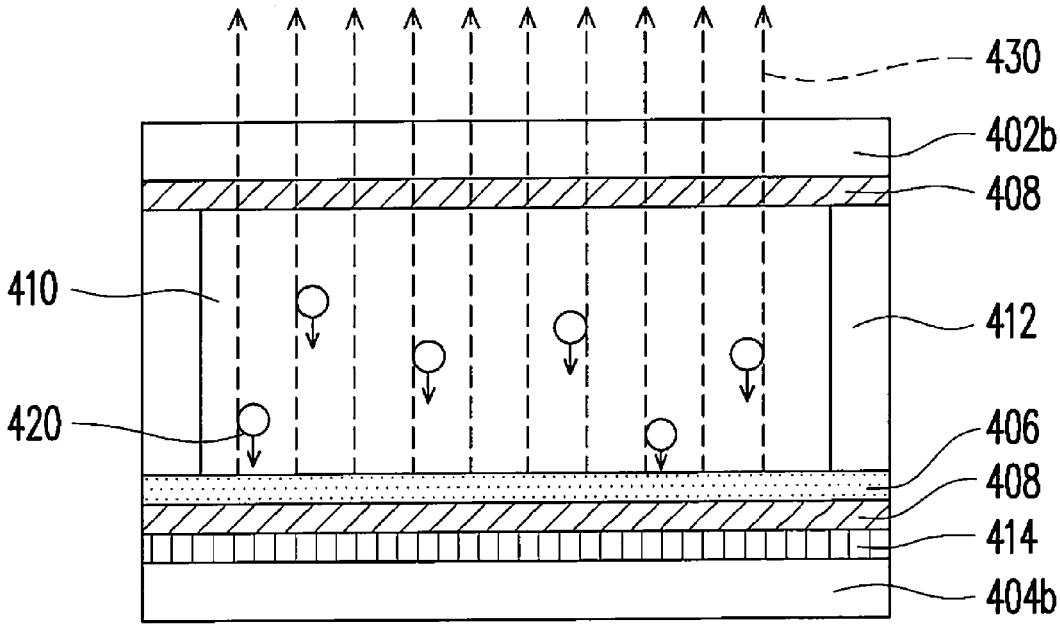
FIG. 10 is a schematic cross-sectional view of a light source apparatus according to an embodiment of the present invention.

The embodiment in FIG. 8 may be implemented in another form as shown in FIG. 10. FIG. 10 is a schematic cross-sectional view of a light source apparatus according to an embodiment of the present invention. The light source apparatus as shown in FIG. 10 has the structure and function similar to the light source apparatus in FIG. 8, and will not be illustrated herein again. Referring to FIG. 10, the difference between the light source apparatus in FIG. 10 and the light source apparatus in FIG. 8 lies in that the discharge layer 408 is disposed on the cathode structure 402*b* and between the reflective layer 414 and the fluorescent layer 406.

In the above embodiment, if a light reflective mechanism is used, the light-emitting surface has a single side. Otherwise, if the light reflective mechanism is not used, the cathode structure and the anode structure are both made of transparent conductive materials to achieve the light transmission properties, such that the dual side light emitting effect can be achieved. Although the light intensity is weak, the light-emitting surface is the dual-side light-emitting surface. The dual-side light-emitting surface may also be modified into a single-side light-emitting surface by adding a reflective layer at the outside of any light-emitting surface. For example, one side of the transparent substrate is a transparent electrode structure, and the other side is formed with a reflective layer, such as a metal evaporated reflective layer.

The Third Embodiment

Figure 11:
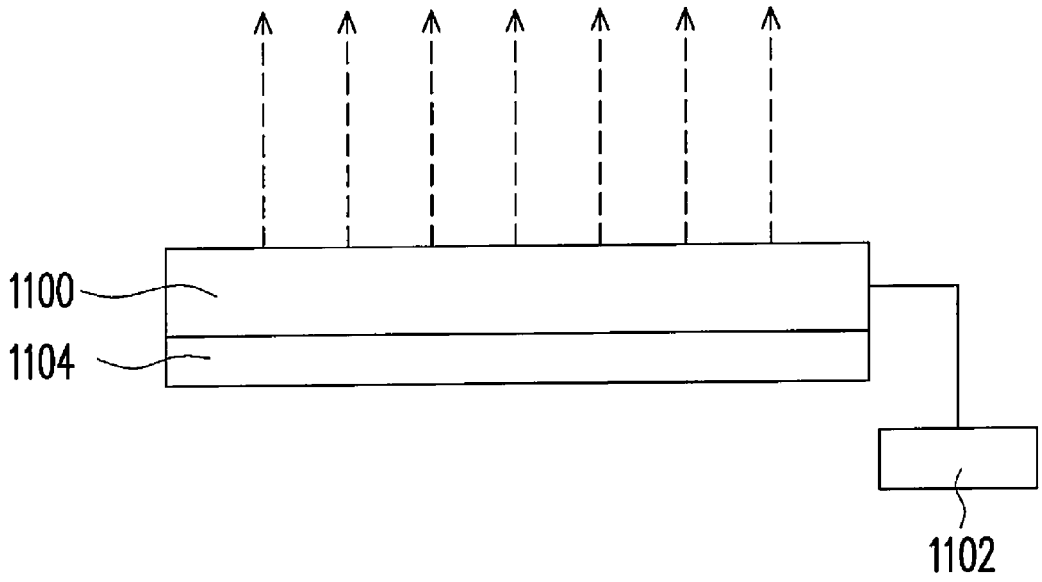
FIG. 11 is a schematic view showing a backlight module structure according to an embodiment of the present invention.

Furthermore, the above light source apparatus may be fabricated into a backlight module for a display. FIG. 11 is a schematic view showing a backlight module structure according to an embodiment of the present invention. Referring to FIG. 11, the backlight module according to the embodiment of the present invention is formed by a light emitting panel 1100 consisting of the above light emitting device, and an operating voltage thereof is provided by a power controller 1102. Moreover, a heat sink mechanism 1104 may be, for example, added at the back side of the light emitting panel 1100. The light emitting device of the present invention may be easily fabricated into a large-area planar light source, thereby simplifying the structure and operation of the backlight module and increasing the luminous efficiency.

Figure 12:
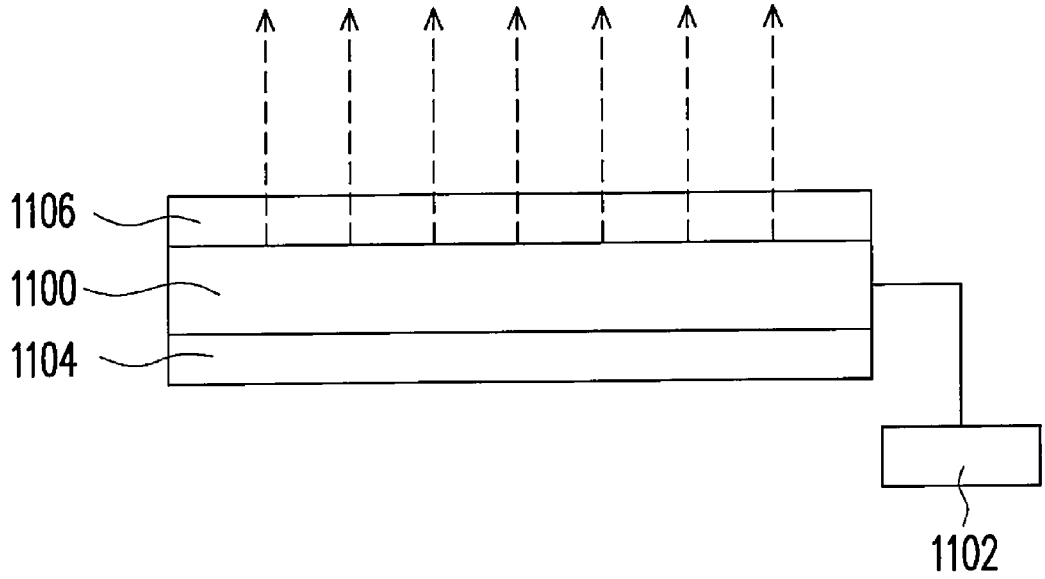
FIGS. 12 to 14 are schematic views showing another backlight module structure according to an embodiment of the present invention.

Moreover, a brightness enhance film (BEF) or a dual BEF (DBEF) may be added so as to increase the directionality and brightness according to the requirements of the backlight module. FIG. 12 is a schematic view showing another backlight module structure according to an embodiment of the present invention. On the basis of the structure in FIG. 11, a brightness enhancement film 1106 is, for example, disposed on the light-emitting surface of the light emitting panel 1100. The brightness enhancement film 1106 includes, for example, a BEF or a DBEF. Moreover, if necessary, another optical film may be needed. For example, a diffusion module may be added between the brightness enhancement film 1106 and the light emitting panel 1100, so as to achieve uniform light intensity.

Figure 13:
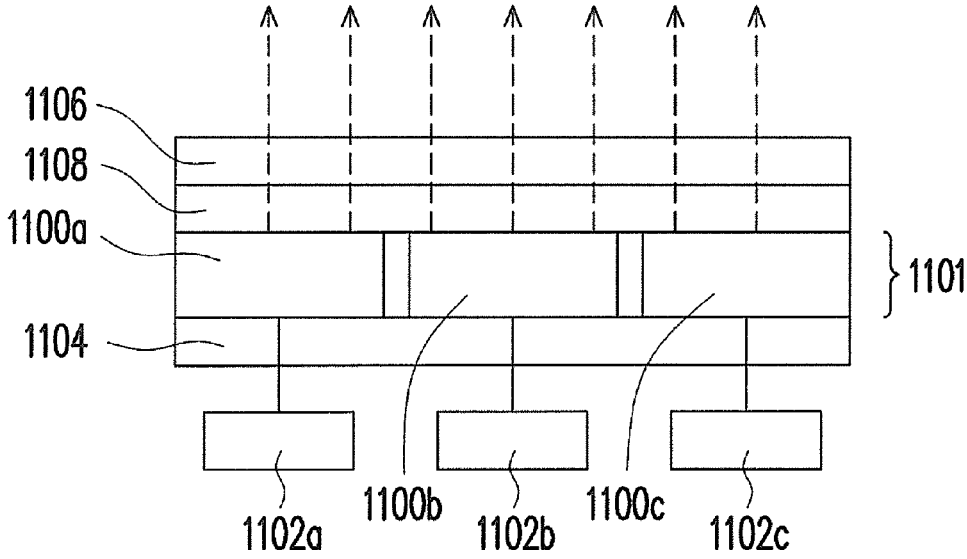

The light emitting module in the above embodiment is formed by a single light emitting panel. However, the light emitting module may also be an array structure including a plurality of light emitting panel units. FIG. 13 is a schematic view showing another backlight module structure according to an embodiment of the present invention. Referring to FIG. 13, the light emitting module 1101 includes, for example, a plurality of light emitting panel units 1100*a*, 1100*b*, 1100*c*. . . which are arranged in an array. The light emitting panel units 1100*a*, 1100*b*, 1100*c* are, for example, controlled by different power controllers 1102*a*, 1102*b*, 1102*c*. . . respectively. In this embodiment, since the light source includes a plurality of light emitting panel units, the original light intensity is non-uniform, a diffusion module 1108 is used in conjunction to uniformly mix the light sources. Then, the brightness enhancement film 1106 is used to emit the diffused lights to the light-emitting surface to the maximum extent, so as to increase the light brightness.

Figure 14:
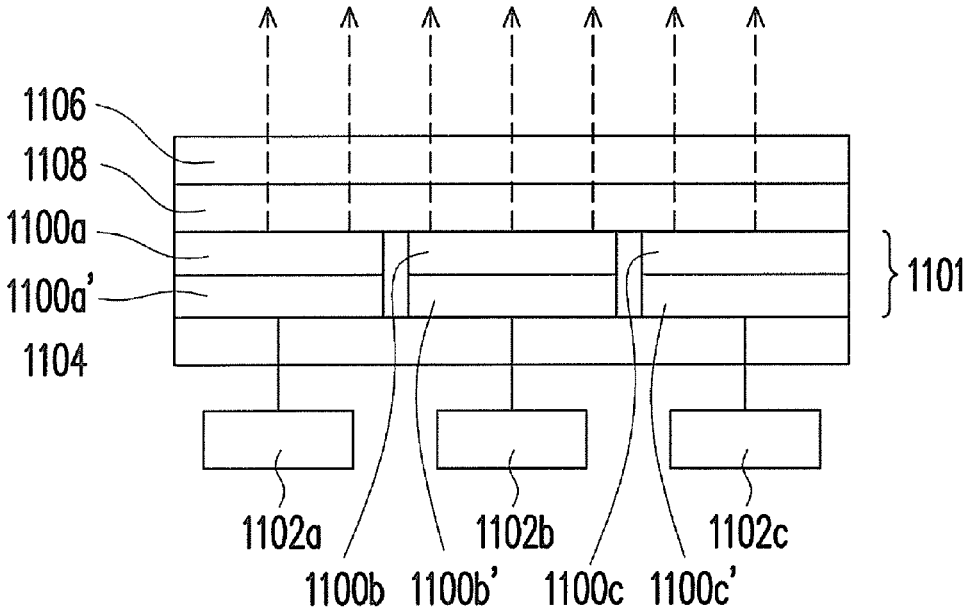

Moreover, in order to increase the light intensity, for example, a plurality of light emitting panel units may be stacked. In FIG. 14 as an example, the light emitting panel units 1100*a*', 1100*b*', 1100*c*'... are stacked with the light emitting panel units 1100*a*, 1100*b*, 1100*c*..., respectively. Moreover, in the application of the backlight module, in order to achieve a single light-emitting surface, a reflecting surface is, for example, formed at the utmost external back side, and further, for example, an electrode is used or a reflective layer is added to achieve the reflective effect.

In view of the above, the light source apparatus provided by the first embodiment of the present invention has a secondary electron generation layer. Since the ionized positive ions in the gas may hit the secondary electron generation layer, additional secondary electrons may be generated when the positive ions hit the secondary electron generation layer on the cathode structure, thereby improving the luminous efficiency.

In the light source apparatus provided by the second embodiment of the present invention, a discharge layer may be disposed on both the cathode structure and the anode structure to reduce the operating voltage.

In the third embodiment of the present invention, the backlight module using the above embodiment may have an improved backlight module performance.

The light source apparatus of the present invention is applicable to the backlight module of a liquid crystal display (LCD). The light source apparatus may increase the light intensity and light uniformity, and further save the cost of the light guide panel and the diffuser required by the cold cathode fluorescence lamp (CCFL). The light source apparatus of the present invention incorporates the advantages of the plasma and field emission light sources. The light source apparatus of the present invention uses the thin gas to uniformly induce electrons from the cathode, thereby avoiding the defect of the difficulty in fabricating the cathode of the field emission light source.

The light source apparatus in the present invention is adapted to personal computers, household TV sets, automobile TV sets, or other devices having the backlight modules of the thin LCD having the relative functions. The field emission light emitting device in this form has the advantages of power saving, short response time, high luminous efficiency, easy to fabricate, environmental-friendly (mercury free), etc.

Different from the conventional field emission light source apparatus, the cathode structure of the light source apparatus of the present invention is merely a planar metal or a conductive film structure without being specially treated or provided with any material, so the structure is simpler. Moreover, the high vacuum packaging is not required in the present invention, and thus the manufacturing process is simplified and the mass production can be easily achieved. The cathode metal structure/high reflective material in the transmissive structure and the anode metal structure/high reflective material in the reflective structure can enhance the reflectivity and increase the brightness and luminous efficiency.

The wavelengths of the emitted lights in the present invention depend upon the types of the phosphors, so the light sources or backlight modules having different wavelengths may be designed depending on the different purposes of illumination or displays. The present invention may be designed to be planar or curved-surface backlight module. In the present invention, the reflective layer of the reflective type can avoid the light guide phenomenon, thereby increasing the brightness and luminous efficiency. The grounding circuit design may be optionally used to eliminate the charge accumulation in the phosphors.

Though the present invention has been disclosed above by the preferred embodiments, they are not intended to limit the present invention. Anybody skilled in the art can make some modifications and variations without departing from the spirit and scope of the present invention. Therefore, the protecting range of the present invention falls in the appended claims and their equivalents.

What is claimed is:

1. A backlight source apparatus, comprising:

at least one power controller, for providing at least one operating voltage;

a light emitting unit, comprising at least one light emitting panel controlled by an operating voltage, wherein the light emitting panel comprises:

a cathode structure as a planar layer;

an anode structure as a planar layer, located opposite to the cathode structure;

a fluorescent layer, located between the cathode structure and the anode structure; and a low-pressure gas layer, filled between the cathode structure and the anode structure, and functioning to induce the cathode to uniformly emit electrons, wherein the low-pressure gas layer comprises a large electron mean free path allowing electrons to directly hit the fluorescent layer under an operating voltage, wherein the at least one light emitting panel is at least one stacked structure, formed by a plurality of light emitting panels.

2. The backlight source apparatus according to claim 1, further comprising a heat sink mechanism disposed on a back side of the light emitting unit.

3. The backlight source apparatus according to claim 1, further comprising a brightness enhancement film disposed on a light-emitting surface of the light emitting unit.

4. The backlight source apparatus according to claim 1, wherein each of the light emitting panels further comprises a secondary electron generation layer as a planar layer located on the cathode structure.

5. The backlight source apparatus according to claim 1, wherein each of the light emitting panels further comprises a discharge layer located on at least one of the cathode structure and the anode structure, the discharge layer is different from the cathode structure and the anode structure in structure and material.

6. The backlight source apparatus according to claim 1, wherein the light emitting unit comprises a plurality of the stacked structures of the light emitting panels.

7. The backlight source apparatus according to claim 1, further comprising a brightness enhancement film disposed at a side of a light-emitting surface of the light emitting unit.

8. The backlight source apparatus according to claim 7, further comprising a diffusion module disposed between the light emitting unit and the brightness enhancement film.

9. The backlight source apparatus according to claim 1, wherein the cathode structure or the anode structure is provided with a light transmission property, and the other is provided with a light reflectivity.

10. The backlight source apparatus according to claim 1. wherein the at least one light emitting panel is an array consisting of a plurality of the stacked structures of the light emitting panels respectively emitting light to form a light emitting surface.

* * * * *

UNITED STATES PATENT AND TRADEMARK OFFICE

CERTIFICATE OF CORRECTION

PATENT NO. : 7,936,118 B2
APPLICATION NO. : 12/039751
DATED : May 3, 2011
INVENTOR(S) : Lin et al.

It is certified that error appears in the above-identified patent and that said Letters Patent is hereby corrected as shown below:

On the Title page of the patent grant, please replace item (30) with the follows:

Foreign Application Priority Data

Mar. 2, 2007 (TW) ..... 96107136 A

Aug. 3, 2007 (TW) ..... 96128647 A

Dec. 14, 2007 (TW) ..... 96147952 A

Signed and Sealed this
Twenty-eighth Day of June, 2011

David J. Kappos

David J. Kappos
*Director of the United States Patent and Trademark Office*